US006142060A

United States Patent [19]

Saito et al.

[11] Patent Number: 6,142,060

[45] Date of Patent: Nov. 7, 2000

[54] HIGH PRESSURE FUEL PUMP HAVING A BELLOWS SEALING ARRANGEMENT

[75] Inventors: Katsumi Saito; Toshihiro Kameda; Satoshi Iitaka, all of Saitama, Japan

[73] Assignee: Honda Giken Kogyo Kabushiki Kaisha, Tokyo, Japan

[21] Appl. No.: 09/076,704

[22] Filed: May 13, 1998

[30] Foreign Application Priority Data

May 19, 1997 [JP] Japan ..... 9-144597

[51] Int. Cl.[7] ..... F01B 3/02

[52] U.S. Cl. ..... 92/71; 92/86; 417/269

[58] Field of Search ..... 417/269; 92/71, 92/86

[56] References Cited

U.S. PATENT DOCUMENTS

| | | | |
|---|---|---|---|
| 4,776,260 | 10/1988 | Vincze | 92/86 |
| 4,858,439 | 8/1989 | Sawada et al. | 92/86 |
| 5,743,370 | 4/1998 | Thomire | 92/86 |

FOREIGN PATENT DOCUMENTS

| | | |
|---|---|---|
| 2 454 544 | 11/1980 | France . |
| 31 40 742 A1 | 4/1983 | Germany . |
| 196 43 134 A1 | 4/1997 | Germany . |
| 7-12029 | 1/1995 | Japan . |
| 04 362280 | 12/1995 | Japan . |
| 8-232850 | 9/1996 | Japan . |

*Primary Examiner*—Charles G. Freay
*Attorney, Agent, or Firm*—Armstrong, Westerman, Hattori, McLeland & Naughton

[57] ABSTRACT

There is provided a high pressure fuel pump which includes a reliable fuel seal having a long durability and which can be produced at a relatively low cost. When a rotating shaft 4 is rotated to rotate a swash plate 7, such rotation is transmitted to a piston shoe guide plate 8 through a thrust ball bearing 9. Since the plate 8 is supported by a spherical portion 16 of a rod 14 mounted to a body 12, the plate 8 performs a precession to recurrently operate a plurality of fuel pumps 21 to 25 disposed around the rod 14. Each of the fuel pumps 21 to 25 includes a bellows provided between an outer end of the piston and the body 12, and the bellows completely seals a fuel leaked from a sliding clearance between the piston and the cylinder. Since the leaked fuel is introduced into a return passage 19 through a groove formed in an outer wall of the cylinder, a large internal pressure is not applied to the bellows and therefore, the bellows can be made of a low-priced material such as Teflon.

23 Claims, 4 Drawing Sheets

HIGH PRESSURE FUEL PUMP HAVING A BELLOWS SEALING ARRANGEMENT

BACKGROUND OF THE INVENTION

1. Field of the Invention

The present invention relates to a high pressure fuel pump, and more particularly, to a high pressure fuel pump for increasing a fuel pressure supplied to an internal combustion engine.

2. Description of the Related Art

As a high pressure fuel pump, there is a conventionally known plunger pump which pressurizes a fuel by a plunger sliding in a cylinder. In such a plunger pump, if a gasoline having a relatively low viscosity as the fuel, a fuel leaked from a clearance between the cylinder and the plunger enters into a mechanical sliding portion which reciprocates the plunger through a driving shaft. Therefore, since the mechanical sliding portion can not be lubricated using grease or oil, a product in which the mechanical sliding portion is lubricated by gasoline has become commercially practical. However, a product in which the gasoline is used as a lubricant does not have sufficient mechanical efficiency and durability.

High pressure pumps which have overcome the above described problem are described in Japanese Patent Applications Laid-open No.8-232850 and No.7-12029.

The former publication discloses an axial swash plate bellows type fuel pump in which a thrust bearing is mounted to an inclined brim portion of a rotating shaft to form a swash plate, and a plurality of pump chambers constituted by bellows are sequentially expanded and contracted by rotating the swash plate, thereby pressurizing the fuel supplied into the pump chambers. According to this prior art, since the pump chamber is constituted by the bellows, it is possible to prevent the fuel from leaking from the pump chamber.

The latter publication discloses a technique in which in order to prevent a fuel leaked from a sliding clearance between a piston and a cylinder of a high pressure fuel pump from entering into a grease charged in a bearing, a needle bearing and the like, a diaphragm is provided between a chamber accommodating the piston and the cylinder and a chamber accommodating the needle bearing and the like, thereby liquid-tightly sealing both the chambers.

However, in the technique disclosed in the former publication in which the pump is constituted by the bellows, a high pressure is directly applied to the bellows and therefore, there is a problem that the bellow must be made of metal having a high pressure resistance, which is expensive.

In the conventional technique disclosed in the latter publication, if the pump has a single cylinder, the operation of the diaphragm is a simple vertical movement and there seems to be no special problem. However, in the case of a high pressure fuel pump, in order to reduce a discharge pulse, the pump has a plurality of plungers and is formed into an axial plunger shape in general. In this case, if a seal diaphragm is provided for every plunger, its size is increased and is not practical. In order to avoid this problem, if the plurality of plungers is sealed by a single diaphragm, there is a problem that a motion of the diaphragm at the time of operation of the plungers is partially varied, which largely deteriorates the durability of the diaphragm.

SUMMARY OF THE INVENTION

It is an object of the present invention to overcome the above described conventional problems, and to provide a high pressure fuel pump having a high durability and a high fuel sealing performance. Another object of the invention is to provide a reliable high pressure fuel pump having a long lifetime in which a circularly disposed plurality of fuel pumps can be operated recurringly. Another object of the invention is to provide a compact high pressure fuel pump.

To achieve the above objects, according to a first feature of the present invention, a bellows is disposed such as to surround the piston such that opposite ends of the bellows are fixed, through a seal member, to an outer end of the piston and to a portion of the body in the vicinity of the cylinder and a fuel leaked from a sliding clearance between the piston and the cylinder is sealed by the bellows. With this feature, a mechanical sliding portion which reciprocates the piston from the driving shaft can be lubricated by grease or oil, it is possible to enhance the mechanical efficiency and durability.

According to a second feature of the invention, a space surrounded by the bellows and a return passage is connected to each other directly or through a groove so that a large internal pressure is not applied to the bellows. With this feature, the bellows can be made of low-priced material having smaller operating resistance and excellent adhesion property with respect to the piston operation such as Teflon.

According to a third feature of the invention, the bellows is formed at its outer end at the side of the body with a recess, and a portion of a bellows-holding plate is fitted in the recess so that the plurality of fuel pumps can be disposed compactly.

According to a fourth feature of the invention, a rotating shaft is provided at its tip end with: a disc-like swash plate obliquely coupled to the rotating shaft; thrust ball bearings disposed around the disc-like swash plate; and piston shoe guide plates each swings by a force transmitted through the thrust ball bearing when the rotating shaft is rotated; and each of the piston shoe guide plates is slidably supported by a spherical portion provided at a tip end of a rod which stands on a center of a body of the high pressure fuel pump. With this feature, it is possible to provide a reliable high pressure fuel pump having a long lifetime in which the plurality of circularly disposed fuel pumps can be operated recurrently.

DETAILED DESCRIPTION OF THE PREFERRED EMBODIMENTS

Figure 1:
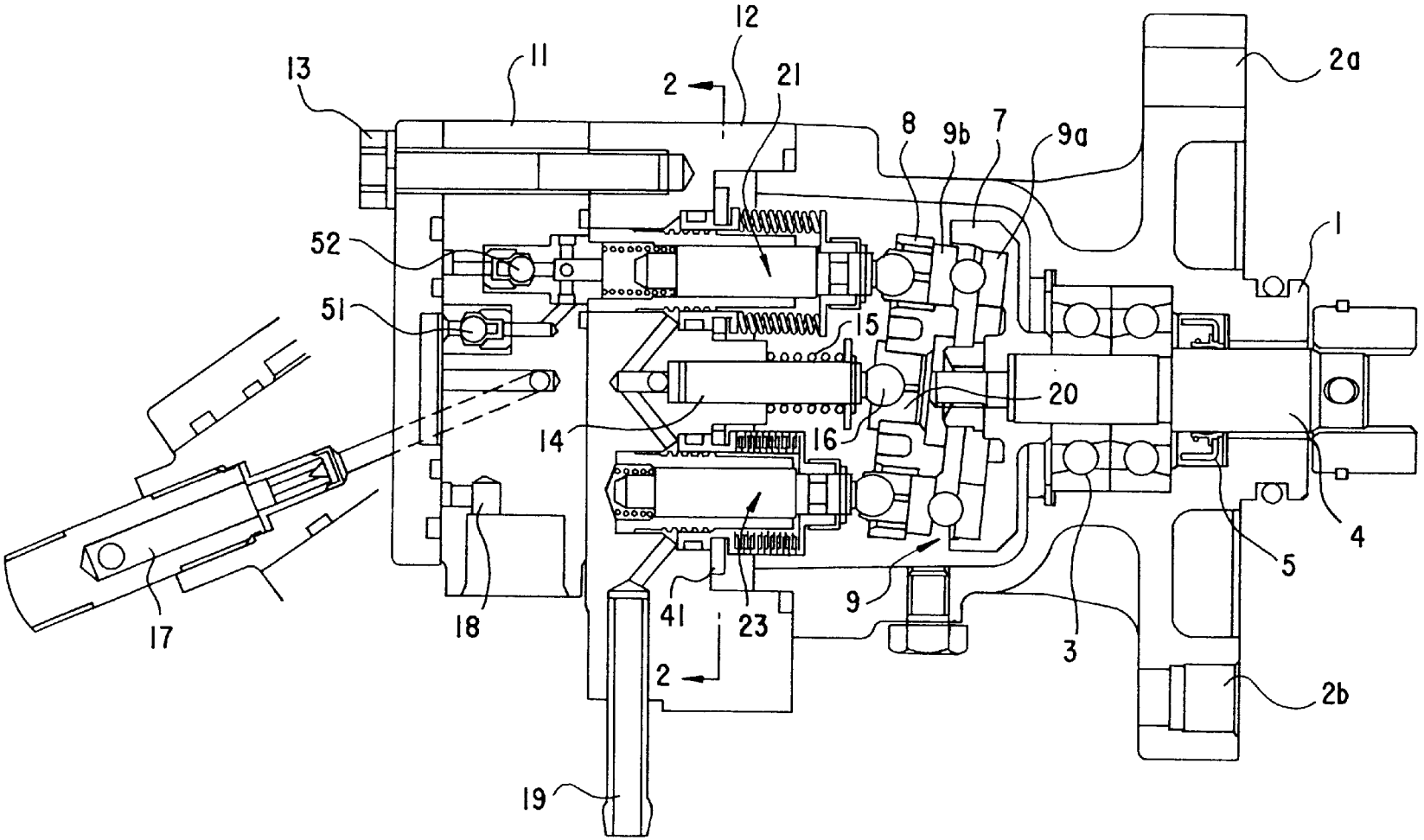
FIG. 1 is a sectional view of a high pressure fuel pump according to an embodiment of the present invention.

The present invention will be described in detail with reference to the accompanying drawings below. FIG. 1 is a sectional view of a high pressure fuel pump according to an embodiment of the present invention. A case 1 of the high pressure fuel pump is provided at its outer end with fixtures for mounting the case 1 to a portion of a cylinder head of an internal combustion engine (not shown), e.g., holes 2*a* and 2*b* through which bolts are passed. The case 1 rotatably supports a rotating shaft 4 through a bearing 3 on a center line within the case 1. An oil seal 5 is provided between the case 1 and the rotating shaft 4. The rotating shaft 4 is connected at its outer end with a camshaft (not shown) mounted to the cylinder head and is rotated. A rotating disc 7 is mounted to an inner end of the rotating shaft 4 such that the rotating disc 7 is inclined with respect to the rotating shaft. The rotating disc 7 is referred to as a swash plate 7 hereinafter. One of bearing races (9*a*) of the thrust ball bearing 9 is fixed to the swash plate 7, and the other bearing race 9*b* is fixed to a piston shoe guide plate 8 provided such as to oppose to the swash plate 7.

A pump head 11 and a body 12 are coupled to each other by a bolt 13. The body 12 is provided on its center axis with a rod 14. The rod 14 is provided at its end projecting toward the swash plate 7 with a spherical portion 16. The rod 14 is pressed in a direction of the rotating shaft 4 by a spring 15 around the rod 14. The piston shoe guide plate 8 is provided at its central portion with a spherical receiving portion 20. The spherical receiving portion 20 accommodates the spherical tip end 16 of the rod 14. The piston shoe guide plate 8 is pushed and supported toward the swash plate 7 by the rod 14. The spherical receiving portion 20 can be made of material suitable for sliding movement, such as phosphor bronze. A supply passage 17 is a passage for supplying a fuel, and an output passage 18 is a passage for outputting a compressed fuel. A return passage 19 is a passage for returning, to a fuel tank (not shown), a fuel leaked from a clearance between a cylinder and a piston of a fuel pump which will be described later.

Figure 2:
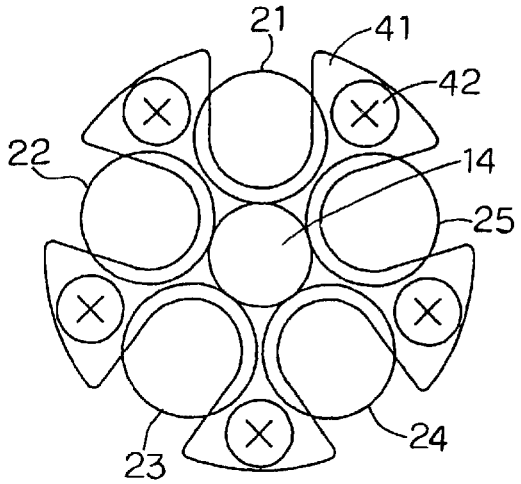
FIG. 2 is a sectional view taken along the line A–A' in FIG. 1 for showing positions and shapes of a fuel pomp and a bellows-holding plate.
Figure 3:
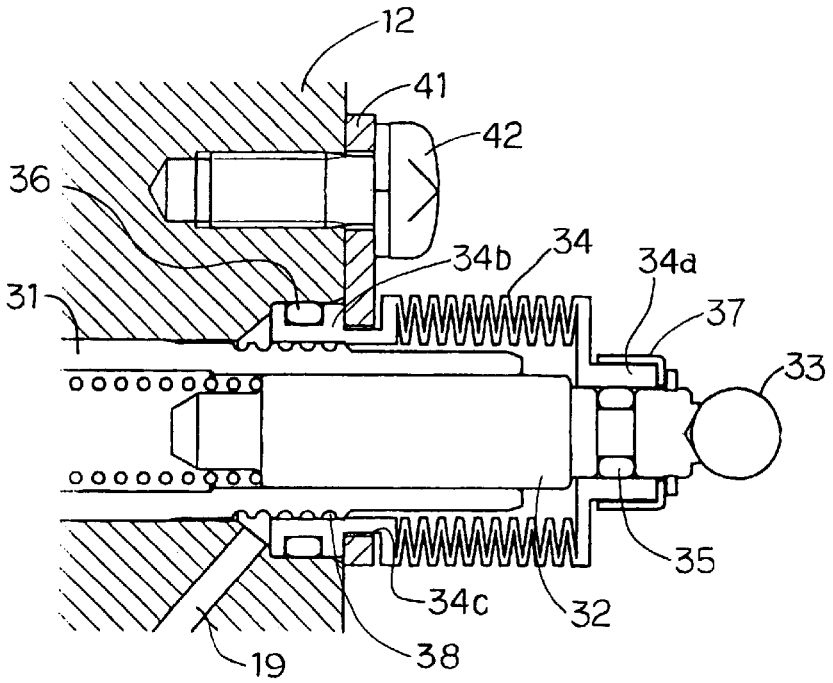
FIG. 3 is an enlarged sectional view of the fuel pump.

As shown in FIG. 2 which shows a cross section taken along the line A–A' in FIG. 1, five fuel pumps 21 to 25 are disposed around the rod 14 in the body 12. As is shown in FIG. 3 in detail, each of the fuel pumps 21 to 25 includes a cylinder 31 and a piston 32 reciprocating in the cylinder 31, a spherical portion 33 is mounted to an outer end of the piston 32, and a bellows 34 is provided outside the cylinder 31 and the piston 32 for completely sealing a fuel leaked from the clearance between the cylinder 31 and the piston 32. The bellows 34 is preferably made of resin such as Teflon. One end 34*a* of the bellows 34 is mounted to the piston 32 through an O-ring 35, and the other end 34*b* is mounted to the body 12 through another O-ring 36. In order to prevent the mounting portion of the bellows 34 from being deformed, the one end 34*a* is pushed toward the piston 32 through the O-ring 35 by a backup guide plate 37, and the other end 34*b* is guided by the cylinder 31. The cylinder 31 opposed to the other end 34*b* is formed at its outer peripheral surface with a fuel introducing passage 38 comprising a spiral groove. A fuel leaked from the sliding clearance between the cylinder 31 and the piston 32 is sent to the return passage 19 through the clearance between the bellows 34 and an outer wall of the cylinder 31 and through the introducing passage 38 comprising the spiral groove. The shape of the introducing passage 38 should not be limited to the spiral groove, and may be formed into other shape.

As shown in FIGS. 2 and 3, each of the bellows 34 mounted to the five fuel pumps 21 to 25 is fixed to the body 12 by a bellows-holding plate 41 comprising a notched plate which opens in a circumferential direction so that the bellows 34 should not be loosed out from the body 12. The bellows-holding plate 41 is fixed to the body 12 by a screw 42. Since the bellows-holding plate 41 is designed such that it is fitted into a recess 34*c* formed in the other end 34*b* of the bellows 34, the five fuel pumps 21 to 25 can be disposed close to the rod 14 as shown in FIG. 2. As a result, the high pressure fuel pump can be made smaller.

Figure 4:
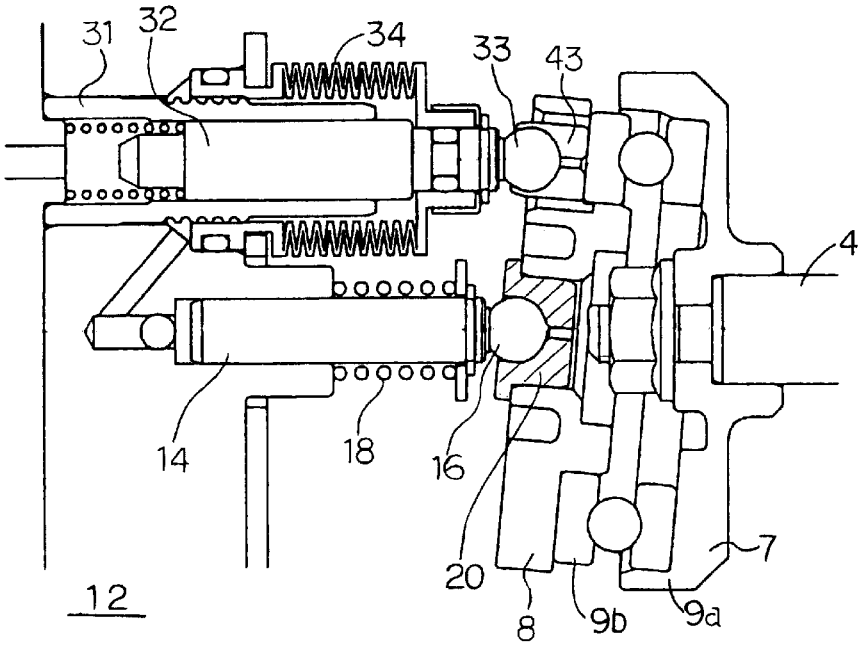
FIG. 4 is a structure of a piston shoe guide plate and a rod for supporting a center thereof, and a spherical receiving portion.

The spherical portion 33 fixed to the outer tip end of the piston 32 of each of the fuel pumps 21 to 25 is accommodated in the piston shoe 43 of the piston shoe guide plate 8 as shown in FIG. 4. The piston shoe guide plate 8 is made of light metal such as aluminum for reducing the weight. The spherical receiving portion 20 is preferably made of material suitable for sliding movement such as phosphor bronze as described above.

Intake valves 51 and discharge valves 52 respectively corresponding to the fuel pumps 21 to 25 are disposed in the pump head 11 shown in FIG. 1. A fuel discharged from the discharge valve 52 is received from the output passage 18 through a cylindrical passage which is not shown, and is sent to the internal combustion engine.

Next, an operation of the high pressure fuel pump having the above described structure will be explained. Hypothesize that the rotating shaft 4 is now receiving a motive power from the camshaft provided in the cylinder head and is rotating. In this case, the swash plate 7 coupled to the rotating shaft 4 also rotates at the same rotating speed. If the swash plate 7 rotates, the piston shoe guide plate 8 opposed to the swash plate 7 receives a force through the thrust ball bearing 9 and as a result, the piston guide plate 8 synchronizes with the rotation of the swash plate 7, causing a precession of the piston guide plate at the center of the spherical portion 16 provided at the tip end of the rod 14. That is, while the swash plate 7 makes one rotation, the five fuel pumps 21 to 25 sequentially conduct a cycle of drawing, compressing and discharging of fuel, cycle by cycle. As a result, the discharge pulse can be lowered. The drawing of fuel can be conducted by opening the intake valve 51 for drawing a fuel such as gasoline sent from the fuel tank through he supply passage 17.

Fuel sequentially pressurized by the five fuel pumps 21 to 25 are collected to the cylindrical passage through respective discharge valves 52, and are sent to the internal combustion engine through the output passage 18.

While the five fuel pumps 21 to 25 repeat the cycle of drawing, compressing and discharging of fuel, the fuel leaked from the sliding clearance between the cylinder 31 and the piston 32 is collected into the return passage 19 through the spiral introducing passage 38 provided in the outer peripheral surface of the cylinder 31. At that time, the leaked fuel should not flow out from the fuel pumps 21 to 25 by means of the bellows 34. Further, since the spiral introducing passage 38 is provided, a high pressure is not generated within the bellows 34. Therefore, the bellows 34 can be made of low-priced and light resin such as Teflon.

Further, according to the present embodiment, since the thrust ball bearing 9 is interposed between the swash plate 7 coupled to the rotating shaft 4 and the piston shoe guide plate 8, the rotating force of the rotating shaft 4 can be absorbed by the thrust ball bearing 9. Therefore, a relative sliding motion of the piston shoe 43 is reduced, and the durability is enhanced. Furthermore, since the spherical portion 16 provided at the tip end of the rod 14 is received by the spherical receiving portion 20, the precession of the piston shoe guide plate 8 can be made more smoothly, and the durability of the piston shoe guide plate 8 can be enhanced.

Figure 5:
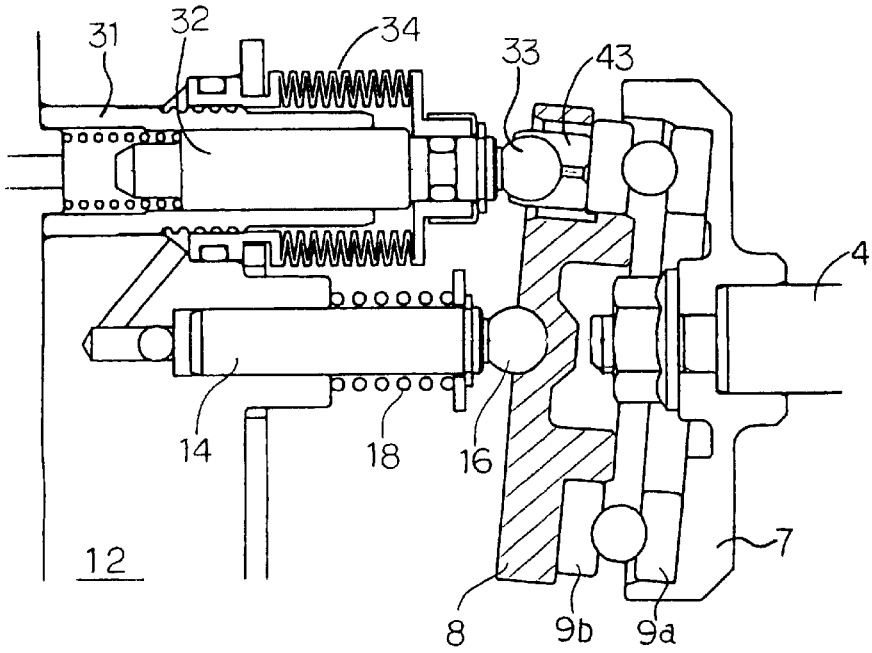
FIG. 5 is a view showing a modification of FIG. 4.

Next, a modification of the spherical receiving portion 20 is explained with reference to FIG. 5. This modification is characterized in that the spherical portion 16 provided at the tip end of the rod 14 is directly received by a spherical receiving portion which is integrally formed with the piston shoe guide 8. With this structure, the spherical receiving portion 20 which was separate from the piston shoe guide plate 8 can be omitted, which can further reduce the price.

Figure 6:
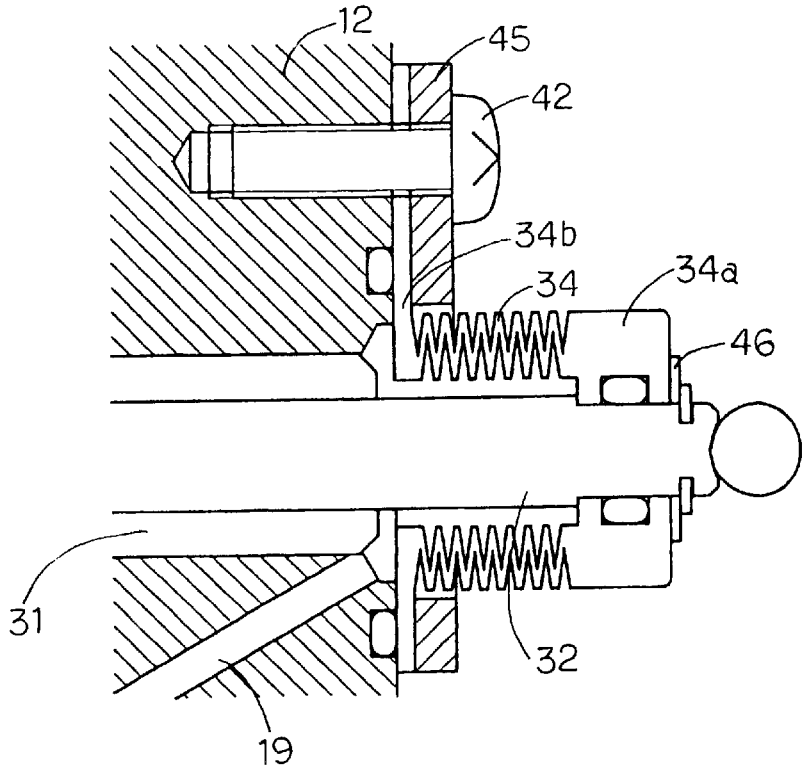
FIG. 6 is a view showing another embodiment of the fuel pump of the present invention.
Figure 7:
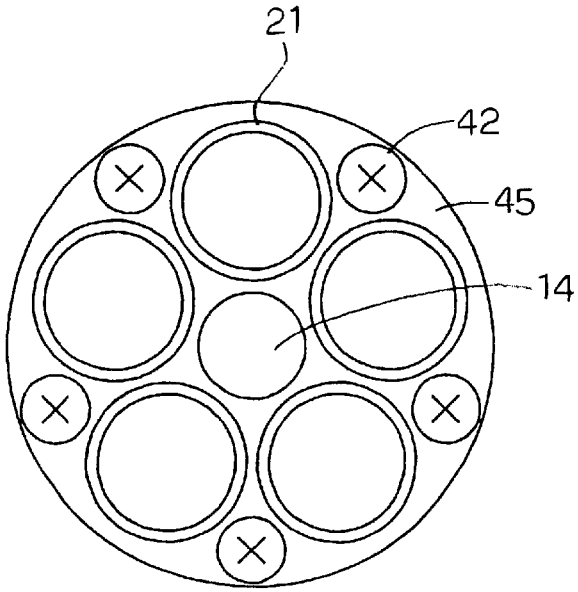
FIG. 7 is a view showing a bellows-holding plate according to the another embodiment.

A second embodiment of the present invention will be described next with reference to FIGS. 6 and 7. Elements similar to those shown in FIGS. 2 and 3 are designated denoted by the same reference numerals. As illustrated in FIGS. 6 and 7, the one end 34*a* of the bellows 34 is mounted to the piston 32 by the plate-holding member 46, and the other end 34*b* is mounted to the body 12 by a screw 42 through the bellows-holding plate 45. The return passage 19 includes an entrance between an end of the cylinder 31 and the other end 34*b* of the bellows 34. Therefore, unlike the first embodiment, it is unnecessary to provide the spiral introducing passage 38 in the outer periphery of the cylinder 31. Unlike the modification of the first embodiment, since the bellows-holding plate 45 is not fitted to the recess 34*c* formed in the end of the bellows 34, the five fuel pumps 21 to 25 can not be disposed close to the rod 14. Therefore, the second embodiment is inferior to the first embodiment in that the high pressure fuel pump can not be made smaller.

As is apparent from the above description, according to the present invention, since the fuel leaked from the sliding clearance between the piston and the cylinder can be sealed completely by the bellows, it is possible to lubricate, using grease or oil, the mechanical sliding portion which translates the rotation of the driving shaft into the reciprocation of the piston, and it is possible to enhance the mechanical efficiency and the reliability.

Further, according to the present invention, since a high pressure is not applied directly to the bellows, the bellows can be made of low-priced material such as Teflon. Therefore, the manufacturing cost of the high pressure fuel pump can be lowered.

Furthermore, according to the present invention, since the bellows-holding member having an opening outside is formed in the bellows-holding plate, and the bellows-holding member is fitted to the recess formed in the outside of the end at the side of the body of the bellows, the plurality of fuel pumps can be disposed compactly, and the small high pressure fuel pump can be produced.

Further, according to the present invention, since the piston shoe guide plate recurringly pressing the pistons of the plurality of fuel pumps is swingably supported by the spherical portion provided at the tip end of the rod which stands at the center of the body of the high pressure fuel pump, it is possible to provide a reliable high pressure fuel pump having a long lifetime.

What is claimed is:

1. A high pressure fuel pump, in which a plurality of fuel pumps disposed circularly are recurringly operated to output high pressure fuel, comprising:

a cylinder which is fixed to a body of said high pressure fuel pump;

a piston reciprocating within said cylinder for drawing, compressing and discharging a fuel; and a bellows disposed such as to surround said piston such that one of opposite ends of said bellows is fixed, through a seal member, to an outer end of said piston and to a portion of said body in the vicinity of said cylinder.

2. A high pressure fuel pump according to claim 1, wherein a leaked-fuel return passage having an entrance in a space surrounded by said bellows is provided.

3. A high pressure fuel pump according to claim 1, wherein an end of said bellows at the side of said body includes an inner peripheral surface which is in contact with an outer periphery of a portion of said cylinder, a groove is formed in a contact portion of said outer periphery of the portion of said cylinder with said inner peripheral surface, and a fuel leaked from the sliding clearance between said piston and said cylinder is introduced into said leaked-fuel return passage through said groove.

4. A high pressure fuel pump according to claim 3, wherein said groove is formed into a spiral shape.

5. A high pressure fuel pump according to claim 1, wherein said bellows is made of resin.

6. A high pressure fuel pump according to claim 2, wherein said bellows is made of resin.

7. A high pressure fuel pump according to claim 3, wherein said bellows is made of resin.

8. A high pressure fuel pump according to claim 4, wherein said end of said bellows at the side of said body further includes a recess, and a portion of a bellows-holding plate is fitted in said recess.

9. A high pressure fuel pump according to claim 5, wherein said end of said bellows at the side of said body further includes a recess, and a portion of a bellows-holding plate is fitted in said recess.

10. A high pressure fuel pump according to claim 6, wherein said end of said bellows at the side of said body further includes a recess, and a portion of a bellows-holding plate is fitted in said recess.

11. A high pressure fuel pump according to claim 7, wherein said end of said bellows at the side of said body further includes a recess, and a portion of a bellows-holding plate is fitted in said recess.

12. A high pressure fuel pump according to claim 8, wherein said bellows-holding plate includes an outwardly opened arc portion having a size corresponding to said recess formed at said outer end of said bellows at the side of said body, and said bellows-holding plate is fixed to said body.

13. A high pressure fuel pump according to claim 9, wherein said bellows-holding plate includes an outwardly opened arc portion having a size corresponding to said recess formed at said outer end of said bellows at the side of said body, and said bellows-holding plate is fixed to said body.

14. A high pressure fuel pump according to claim 10, wherein said bellows-holding plate includes an outwardly opened arc portion having a size corresponding to said recess formed at said outer end of said bellows at the side of said body, and said bellows-holding plate is fixed to said body.

15. A high pressure fuel pump according to claim 11, wherein said bellows-holding plate includes an outwardly opened arc portion having a size corresponding to said recess formed at said outer end of said bellows at the side of said body, and said bellows-holding plate is fixed to said body.

16. A high pressure fuel pump according to claim 5, wherein said bellows is made of TEFLON.

17. A high pressure fuel pump according to claim 6, wherein said bellows is made of TEFLON.

18. A high pressure fuel pump according to claim 7, wherein said bellows is made of TEFLON.

19. A high pressure fuel pump, in which a plurality of fuel pumps disposed circularly are recurringly operated to output high pressure fuel, comprising:

a rotating shaft;

a disc-shaped swash plate obliquely coupled to an end of said rotating shaft;

thrust ball bearings disposed around said disc-shaped swash plate; and a piston shoe guide plate which swings by a force transmitted through said thrust ball bearing when said rotating shaft is rotated, wherein each of said piston shoe guide plates is slidably supported by a spherical portion provided at a tip end of a rod which stands on a center of a body of said high pressure fuel pump.

20. A high pressure fuel pump according to claim 19, wherein said spherical portion provided at the tip end of said rod is accommodated in a spherical receiving portion provided at a center portion of said piston shoe guide plate.

21. A high pressure fuel pump according to claim 20, wherein said spherical receiving portion is made of material suitable for sliding movement, such as phosphor bronze.

22. A high pressure fuel pump according to claim 19, wherein said piston shoe guide plate is provided at its outer peripheral portion with a plurality of piston shoes accommodating spherical portions coupled to outer tip ends of said pistons of said plurality of fuel pumps.

23. A high pressure fuel pump according to claim 19, wherein said spherical portion provided at the tip end of said rod which stands at the center of said body of said high pressure fuel pump supports said piston shoe guide plate by a repulsive force of a spring.

* * * * *